US006002243A

United States Patent [19]

Marshall

[11] Patent Number: 6,002,243

[45] Date of Patent: Dec. 14, 1999

[54] MOS CIRCUIT STABILIZATION OF BIPOLAR CURRENT MIRROR COLLECTOR VOLTAGES

[75] Inventor: Andrew Marshall, Dallas, Tex.

[73] Assignee: Texas Instruments Incorporated, Dallas, Tex.

[21] Appl. No.: 09/145,700

[22] Filed: Sep. 2, 1998

[51] Int. Cl.[6] ..... G05F 3/16

[52] U.S. Cl. ..... 323/313; 323/315

[58] Field of Search ..... 323/312, 313, 323/314, 315, 316

[56] References Cited

U.S. PATENT DOCUMENTS

| | | | |
|---|---|---|---|
| 4,362,984 | 12/1982 | Holland | 323/313 |
| 4,443,753 | 4/1984 | McGlinchey | 323/313 |
| 4,906,863 | 3/1990 | Van Tran | 327/539 |
| 4,939,442 | 7/1990 | Carvajal et al. | 323/281 |
| 5,168,209 | 12/1992 | Thiel | 323/313 |
| 5,349,286 | 9/1994 | Marshall et al. | 323/315 |
| 5,352,973 | 10/1994 | Audy | 323/313 |
| 5,451,860 | 9/1995 | Khayat | 323/314 |
| 5,614,816 | 3/1997 | Nahas | 323/316 |
| 5,684,394 | 11/1997 | Marshall | 323/315 |

OTHER PUBLICATIONS

A.G. Van Lienden, G.C.M. Meijer and J. Van Drecht, "Latch–Up in Bipolar Low–Voltage Current Sources," IEEE Journal of Solid–State Circuits, vol. SC–22, No. 6, Dec. 1987, pp. 1139–1143.

*Primary Examiner*—Adolf Denske Berhane
*Attorney, Agent, or Firm*—J. Dennis Moore; Wade James Brady, III; Richardson L. Donaldson

[57] ABSTRACT

A reference circuit including a current generation circuit having a first bipolar transistor and a second bipolar transistor connected as a bipolar current mirror and being coupled by way of their emitters and collectors between a voltage source and ground. A MOS circuit is also provided functioning to minimize the voltage difference between the collector of the first bipolar transistor and the second bipolar transistor. In this way, by stabilizing the differences between the voltages at the collector of the first bipolar transistor and at the collector of the second bipolar transistor, the aforementioned problems, i.e., the variations in the output voltage and/or current of the bandgap reference circuit in response to variations in the voltage source, are greatly reduced.

10 Claims, 3 Drawing Sheets

MOS CIRCUIT STABILIZATION OF BIPOLAR CURRENT MIRROR COLLECTOR VOLTAGES

TECHNICAL FIELD OF THE INVENTION

This invention relates to electronic circuits and more particularly relates to voltage and current reference circuits.

BACKGROUND OF THE INVENTION

Many integrated circuits require a stable reference voltage and/or a stable reference current for operation. Examples of circuits which may use such references include data acquisition systems, voltage regulators, virtual grounds, measurement devices, analog-to-digital converters and digital-to-analog converters. The bandgap reference circuit is a common circuit solution for supplying either a voltage reference or current reference. Bandgap reference circuits are illustrated in U.S. Pat. Nos. 5,684,394, 5,349,286, 5,168,209, 4,939,442, 4,906,863 and 4,362,984, all assigned to Texas Instruments Incorporated.

FIG. 1 shows an exemplary prior art bandgap circuit 10. The circuit 10 shown in FIG. 1 is similar to the circuit disclosed in the aforementioned U.S. Pat. No. 5,349,286, especially FIG. 3 thereof. Bandgap circuit 10 is made of three parts, a startup circuit 12, a current reference circuit 14 and a voltage reference circuit 16.

The startup circuit 12 is of well known construction and operation and is not directly relevant to the present invention, so it is not described further herein. Construction and operation of the current reference circuit 14 is similar to that of the circuit of FIG. 3 of the aforementioned '286 patent. P-channel metal oxide semiconductor (PMOS) devices M1, M2, M3 and M4 are connected to a voltage supply, $V_{cc}$, and function as a first MOS cascoded current mirror providing current to bipolar transistors Q1 and Q2, which are configured as a bipolar current mirror. One side of the first MOS current mirror, comprising devices M1 and M3, provides current to the collector of Q1. The other side of the first MOS current mirror, comprising devices M2 and M4, provides current to the collector of Q2.

Q1 and Q2 are sized differently; Q2 is typically four times as large as Q1 Therefore, although they conduct the same current, they have different current densities. As a consequence, there is a difference in their $V_{be}$ voltages and the difference is reflected in the current through resistor R1.

The output voltage $V_{bg}$ from voltage reference circuit 16 is a voltage that is a function of the current through resistor R2 and of the base emitter voltage, $V_{be}$, of bipolar transistor Q3. Since the current through resistor R2 is mirrored from devices M2 and M4, it is seen that the current through PMOS devices M10 and M11 is a function of $\Delta V_{be}$ between bipolar transistors Q1 and Q2 and resistor R1. Therefore, $V_{bg}$ is a function of the $\Delta V_{be}$ between bipolar transistors Q1 and Q2, the ratio and resistor values R1 and R2, and the $V_{be}$ of bipolar transistor Q3.

An n-channel metal oxide semiconductor (NMOS) device M5 is configured as a "beta-helper". PMOS devices M6, M7, M8 and M9 are configured as a second MOS cascoded current mirror which forms a compensation circuit that measures the base drive of bipolar transistors Q1 and Q2 in the current generation circuit 14 and creates a supplemental current for resistor R2 and bipolar transistor Q3 in voltage generation circuit 16. Resistor R2 and bipolar transistor Q3 take the supplemental current and translate it into a supplemental voltage. The supplemental voltage cancels the error provided by current generation circuit 14 due to low gain bipolar transistors Q1 and Q2.

In high performance applications such as voltage regulators, the compensation methodology described hereinabove significantly reduces the error associated with finite gain bipolar transistors in voltage and current reference circuits. In fact, the circuit of FIG. 1 has proven to be an excellent bandgap voltage reference source. However, it has been discovered that certain shortcomings are encountered with the circuit of FIG. 1, especially when it is used in conjunction with newer technologies, which typically have lower Early voltages. Specifically, it has been discovered that variations in the supply voltage $V_{cc}$ cause corresponding variations in the output voltage $V_{bg}$, thereby degrading the desired stable voltage performance. Even more problematically, as process dimensions diminish, it has been discovered that the bandgap voltage variation with power supply voltage variation is correspondingly greater as well.

It is an object of the present invention to provide a compensation apparatus that reduces the problems associated with power supply voltage variations in voltage and current reference circuits. It is another object of the present invention to provide such a compensation apparatus for bandgap reference circuits. Other objects and advantages of the invention will be come apparent to those of ordinary skill in the art having reference to the following specification together with the drawings herein.

SUMMARY THE INVENTION

In accordance with the present invention there is provided a reference circuit including a current generation circuit having a first bipolar transistor and a second bipolar transistor connected as a bipolar current mirror and being coupled by way of their emitters and collectors between a voltage source and ground. A MOS circuit is also provided functioning to minimize the voltage difference between the collector of the first bipolar transistor and the second bipolar transistor. In this way, by stabilizing the differences between the voltages at the collector of the first bipolar transistor and at the collector of the second bipolar transistor, the aforementioned problems, i.e., the variations in the output voltage and/or current of the bandgap reference circuit in response to variations in the voltage source, are greatly reduced.

In a preferred embodiment of the present invention, the aforementioned MOS circuit is configured as a first MOS current mirror. In another preferred embodiment, the current generation circuit is provided with a beta helper coupled between the common base connection node of the first transistor and the second transistor and the voltage source. The current generation circuit also includes a first MOS device and a second MOS device connected as a second MOS current mirror and coupled between the voltage source and the respective collectors of bipolar transistors Q1 and Q2 to provide current to bipolar transistors Q1 and Q2. The gate of the beta helper MOS device is coupled to one side of the second MOS current mirror. In this further embodiment, the first MOS current mirror is made of a third MOS device and a fourth MOS device, configured as a current mirror coupling the sides of the second MOS current mirror to the respective collectors of bipolar transistors Q1 and Q3. Finally, the first MOS current mirror is coupled to the base of the beta helper device so as to minimize the voltage difference between the collectors of bipolar transistors Q1 and Q2 and the second MOS current mirror.

These and other features of the invention will become apparent to those skilled in the art from the following detailed description of the invention, taken together with the accompanying drawings.

DESCRIPTION OF PREFERRED EMBODIMENTS OF THE PRESENT INVENTION

Figure 1:
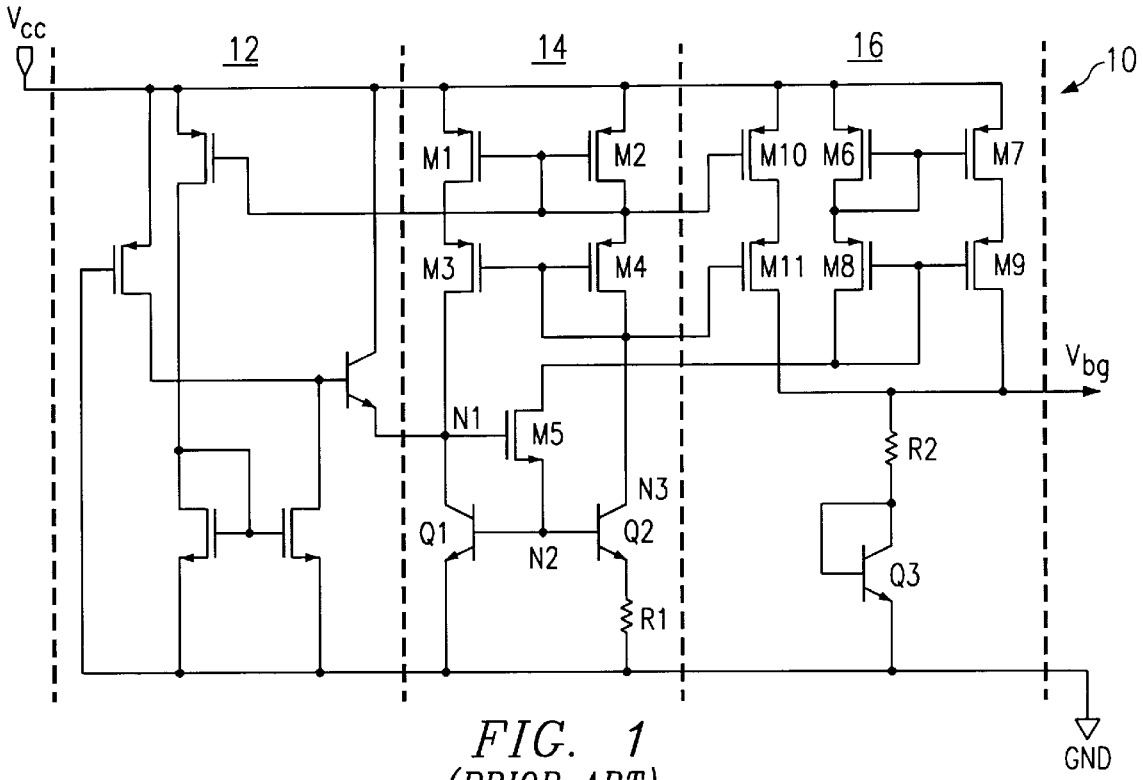
FIG. 1 (PRIOR ART)
FIG. 1 is a schematic diagram illustrating a prior art bandgap circuit 10.

In order to better understand the preferred embodiments of the present invention, it is helpful to understand more fully certain details in the performance of the prior art bandgap circuit 10 shown on FIG. 1. The common base connection of bipolar transistors Q1 and Q2, namely node N2, is at $V_{be}$ in steady state operation, about 0.7 volts at room temperature. Now, the voltage at node N1, which is the common connection point for the gate of device M5 and the collector of bipolar transistor Q1, is at $V_{be}$ plus the gate voltage of device M5, $V_{gm5}$. Node N1 is thus at roughly 1.5 volts during steady state operation.

The problem in the operation of the circuit of FIG. 1 in situations where the supply voltage $V_{cc}$ may vary arise because the Early voltage, $V_a$, of the bipolar transistors Q1 and Q2 is less than ideal. As is known, the gain of a bipolar device having a finite $V_a$ varies with a varying supply voltage across $V_{cc}$, at a constant $I_b$. The lower the value of $V_a$ the greater the variation in gain with varying supply voltage. The consequence of this for the circuit of FIG. 1 is that the voltage at the collector of bipolar transistor Q2, namely node N3, may vary considerably with varying $V_{cc}$. This, in turn, results in a variation in the current from the mirroring devices M10 and M11, which leads to bandgap voltage variations in the output voltage $V_{bg}$.

The problem is being exacerbated with modern technologies. For example, in one new 0.18$\mu$ process technology, an NPN bipolar transistor has a $V_a$ of approximately 20 volts. This is a result of the thinner base regions used in the process. In turn, this low $V_a$ has led to variations in $V_{bg}$ of bandgap voltage reference circuits such as circuit 10 of FIG. 1 that are unacceptably large.

Figure 2:
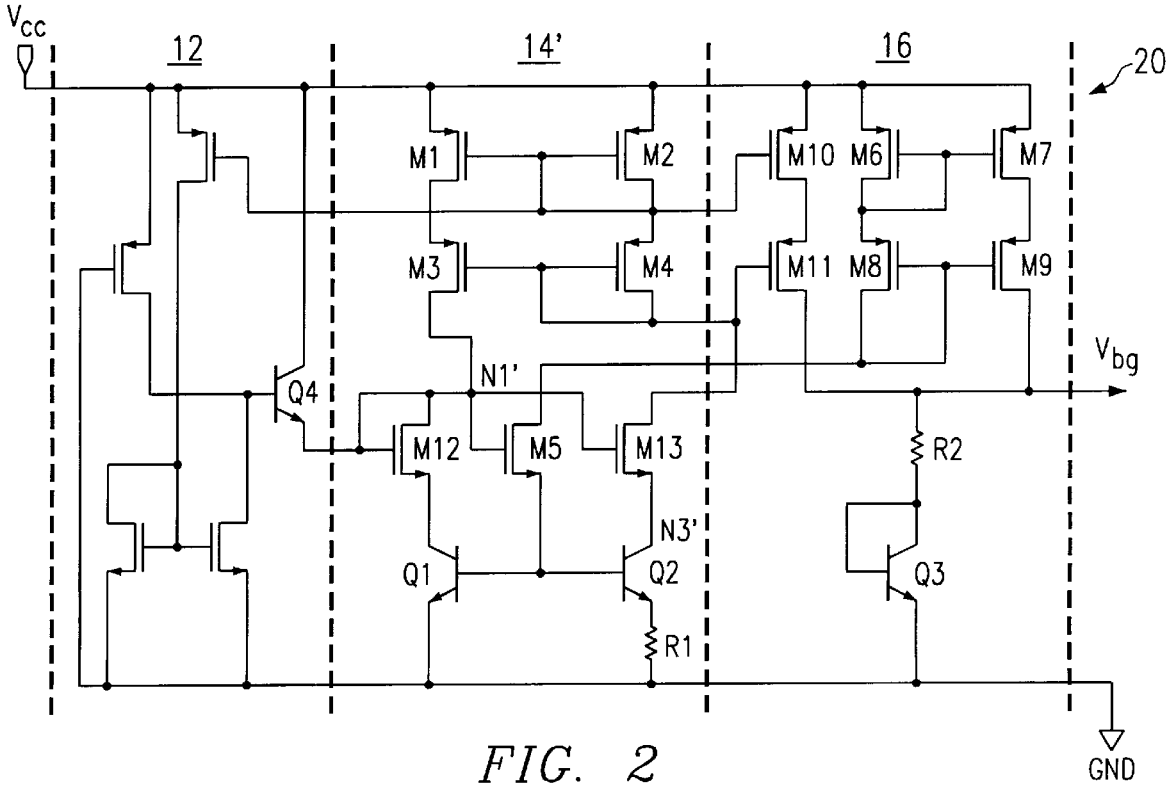
FIG. 2 is a schematic diagram illustrating a preferred embodiment of the invention, a power supply compensated bandgap voltage reference circuit 20.

Turning now to FIG. 2, there is shown a compensated bandgap voltage reference circuit 20 incorporating the principles of the present invention. This reference circuit 20 is similar to the reference circuit 10 of FIG. 1. Like the circuit 10 of FIG. 1 it includes a startup circuit 12 and a voltage reference circuit 16. However, the current reference circuit 14 of FIG. 1 is modified in FIG. 2, and is designated 14'. The difference between the current reference circuit 14' of FIG. 2 and the current reference circuit 14 of FIG. 1 arises from additional NMOS devices M12 and M13 in current reference circuit 14'.

As in the circuit of FIG. 1, the gate of device M5 is connected to one half of the current supply in current reference circuit 14', namely to the drain of current source device M3, and to the emitter of collector Q4 of startup circuit 12, in this figure labeled node N1'. Also connected to node N1', however, is an NMOS device M12, having its drain and gate connected together and connected to node N1'. The source of device M12 is connected to the collector of bipolar transistor Q1. In addition, the source of NMOS device M13 is connected to the collector of bipolar transistor Q2, while the drain of device M13 is connected to the other half of the current supply in current reference circuit 14', namely the common connection node for the gate and drain of device M4. The gate of device M13 is connected to node N1'.

It will be appreciated that devices M12 and M13 are connected as a current mirror having two important characteristics. The first such characteristic is that by their configuration and connection in the current reference circuit 14' they operate in a manner so as to stabilize the voltages appearing at the collectors of bipolar transistors Q1 and Q2 in steady state operation. This stabilization tends to minimize the variations in the voltage at the collector of bipolar transistor Q2 as the power supply voltage $V_{cc}$ varies. This, in turn, stabilizes the current through devices M10 and M11, and thereby the current through the circuit leg made of bipolar transistor Q3 and resistor P2. Thus, the output reference voltage $V_{bg}$ is stabilized with respect to variations in the power supply voltage $V_{cc}$, achieving the desired objective.

The second important characteristic of the current mirror configuration of devices M12 and M13 reflects a preference in the manner in which the principles of the present invention are applied. That is, the voltage range within which the current mirror comprising devices M12 and M13 is constrained by virtue of its connection to node N1' to operate "below" the voltage set at the gate of device M5. Thus, while the advantageous stabilization advantage just described is provided, nonetheless, the additional voltage range "occupied" by devices M12 and M13 in the circuit defined by devices M1, M2, M3, M4, bipolar transistors Q1, Q2, and resistor R1, is minimal. This is an important consideration in modern, small dimension process technologies where the problems solved by the present invention are most problematic, because the operating voltage $V_{cc}$ is typically quite low. The inventive principles are applicable to $V_{cc}$ as low as 2.5 volts, and even lower.

Figure 3:
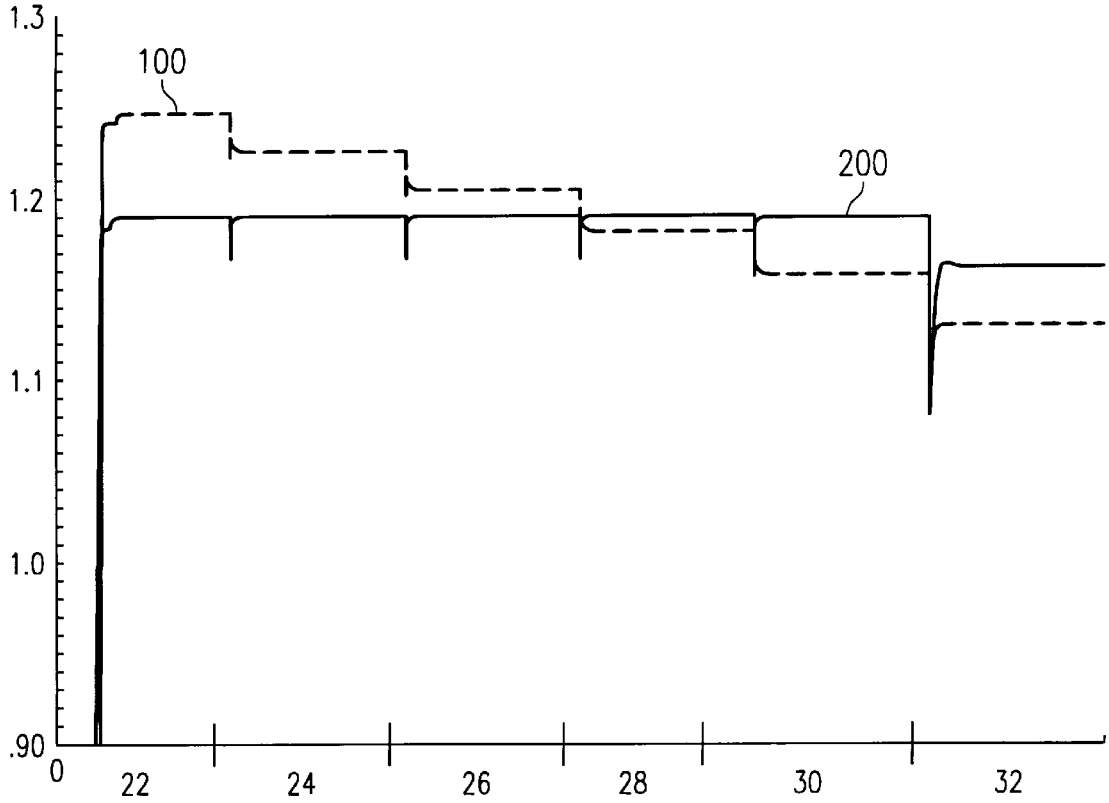
FIG. 3 is a graph showing output bandgap voltage variation, with respect to supply, for an uncompensated circuit and for a circuit compensated in accordance with the present invention.

FIG. 3 shows a typical output bandgap voltage variation, with respect to supply, for a circuit constructed according to FIG. 2 and having bipolar transistors with a relatively low Early voltage, a $V_a$ of approximately 15. The vertical axis represents voltage. The curves of FIG. 3 can be generated by applying for small, fixed periods of time a step-wise successively decreasing $V_{cc}$. Thus, the horizontal axis of FIG. 3 represents time.

The dashed line curve 100 of FIG. 3 represents the bandgap voltage of an uncompensated circuit, for example, a circuit like that shown in FIG. 1. The solid line curve 200 of FIG. 3 represents the bandgap voltage of a circuit compensated in accordance with the principles of the present invention, for example, the circuit of FIG. 2. In the first time segment 22, $V_{cc}$ is 5 volts. In the second segment 24, $V_{cc}$ is 4.5 volts. In the third segment 26, $V_{cc}$ is 4 volts. In the fourth segment 28, $V_{cc}$ is 3.5 volts. In the fifth segment 30, $V_{cc}$ is 3 volts. Finally, in the final segment 32, $V_{cc}$ is 2.5 volts.

As can be seen, across intervals 22, 24, 26, 28 and 30, the uncompensated circuit curve 100 drops with each step-wise drop in $V_{cc}$ from, in this example, 1.25 volts down to approximately 1.15 volts. By contrast, the curve 200 for the compensated reference voltage remains nearly constant across that entire range. Only in the last segment 32, wherein $V_{cc}$ is 2.5 volts, does the compensated reference voltage curve 200 drop significantly. It will be noticed, however, that the drop in curve 200 from segment 30 to segment 32 is less of a drop than the corresponding drop in the uncompensated curve 100 between the same two segments. Thus, in this example, an improvement was observed down to a $V_{cc}$ of 2.5 volts.

Figure 4:
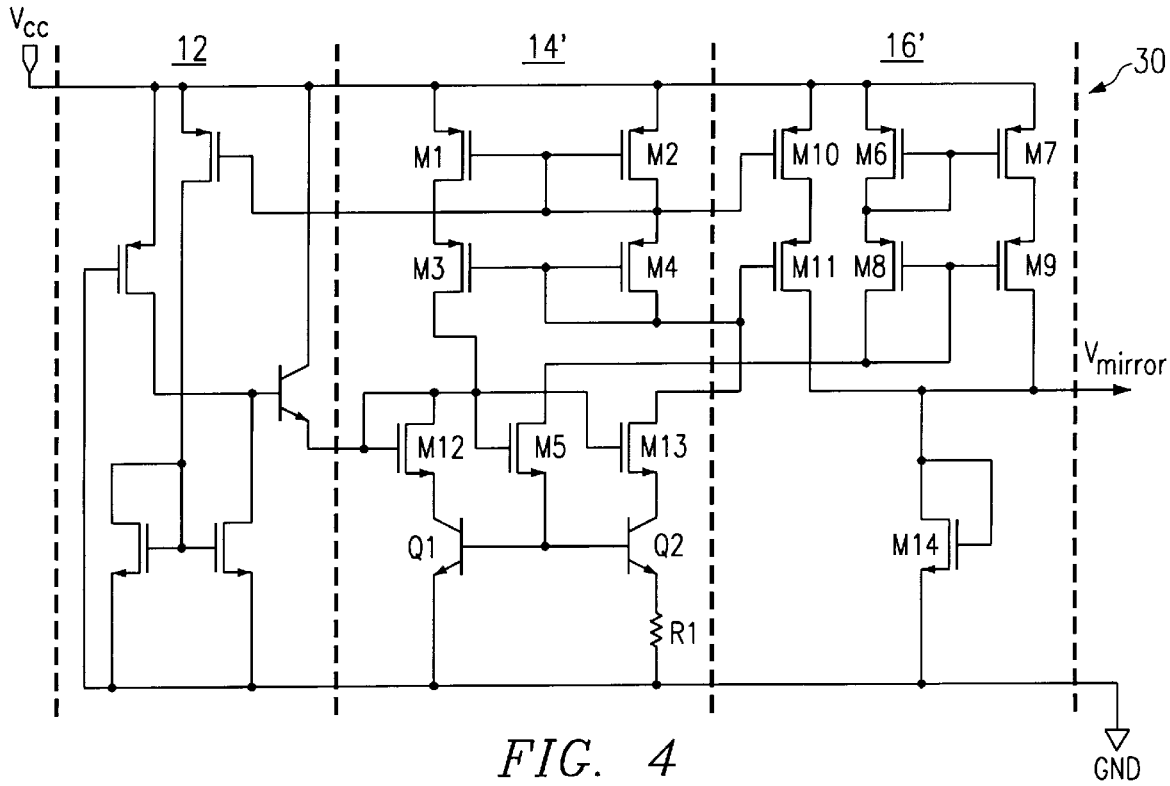
FIG. 4 is a schematic diagram illustrating another preferred embodiment of the invention, a compensated bandgap current reference circuit 30.

FIG. 4 shows a compensated bandgap current reference circuit 30 constructed and operating according to principles similar to those of voltage reference circuit 20 of FIG. 2. Thus, the startup circuit 12 and the current reference circuit 14' are the same as those in circuit 20 of FIG. 2. In the second current reference circuit 16', however, the resistor R2 and bipolar transistor Q3 of FIG. 2 have been replaced by a single NMOS device M14 having its gate and drain connected together and connected to the output node, $V_{mirror}$, and having its source connected to ground. In circuit 30 of FIG. 4, the same compensating benefit is provided by additional devices M12 and M13 as is provided in the circuit 20 of FIG. 2. However, the current mirrored by devices M10 and M11 is mirrored to device M14, which forms one-half of a current mirror. The second half of the current mirror is provided in an external circuit (not shown) to which the reference circuit 30 may be connected. Reference circuit 30 merely illustrates that the principles of the present invention may be applied in the context of a current reference circuit in addition to a voltage reference circuit.

Figure 5:
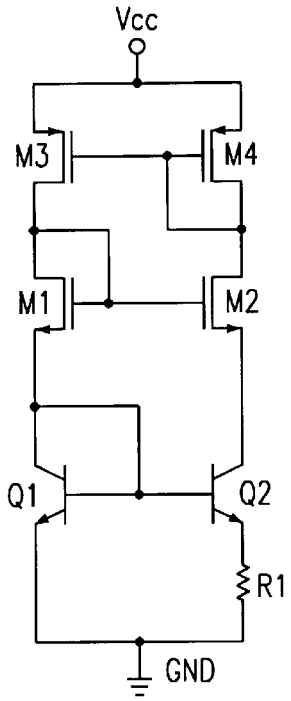
FIG. 5 is still another preferred embodiment of the present invention illustrating more generalized applicability in a bipolar current mirror reference.

FIG. 5 is a schematic diagram showing the application of the principles of the present invention in a generalized way to a bipolar transistor current mirror. The bipolar current mirror is comprised of bipolar transistors Q1 and Q2 having their bases connected together at a common node, wherein the emitter of transistor Q1 is connected to ground, while the emitter of transistor Q2 is coupled to ground through a resistor R1. NMOS device M1 has its source connected to the collector of Q1, and it has its drain and gate connected together and connected to the voltage supply $V_{cc}$. NMOS device M2 has its source connected to the collector of bipolar transistor Q2 and has its drain connected to the voltage supply $V_{cc}$. The gates of devices M1 and M2 are connected together. Devices M1 and M2 operate as a current mirror tending to stabilize the collector voltages of bipolar transistors Q1 and Q2.

Figure 6:
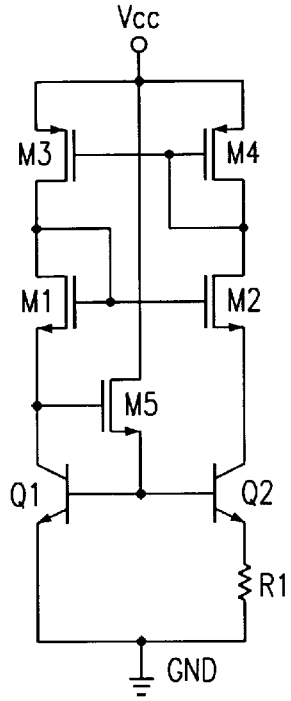
FIG. 6 is a still further preferred embodiment of the present invention illustrating applicability in a bipolar current mirror configuration that includes a beta helper M3.

FIG. 6 is a still further embodiment showing the application of the principles of the present invention. It is similar to the circuit shown in FIG. 5; however, it has additional beta helper NMOS device M3 having its source connected to the common connection point for the bases of bipolar transistors Q1 and Q2, and its drain connected to the voltage supply $V_{cc}$. The base of device M3 is connected to the collector of bipolar transistor Q1. The circuit of FIG. 6 illustrates that the principles of the present invention are applicable to bipolar transistor current mirrors having a beta helper without being constrained to having the voltage range of operation of the compensating current mirror operating "beneath" the voltage defined by the beta helper device, as is the case in the circuits of FIGS. 2 and 4. However, as was stated above, providing the compensating current mirror of the present invention in a way so as to operate beneath the voltage defined by the gate of the beta helper in such circuits is highly advantageous for the reasons set forth hereinabove, and is considered preferred.

Figure 7:
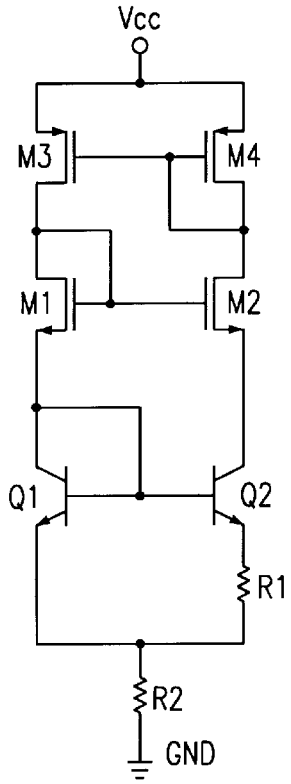
FIG. 7 is a preferred embodiment of the present invention like that of FIG. 5, but in a reference voltage configuration.
Figure 8:
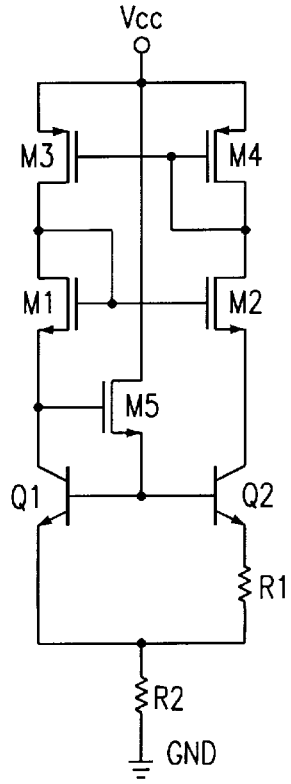
FIG. 8 is a preferred embodiment of the present invention like that of FIG. 6, but in a reference voltage configuration.

FIGS. 7 and 8 are similar to FIGS. 5 and 6, respectively. However, in each of FIGS. 7 and 8 an additional resistor R2 is inserted between the common connection point of the emitter of bipolar transistor Q1 and the negative connection point of resistor R1, and ground. FIGS. 7 and 8 show that the principles of the present invention can be applied in voltage reference applications. In the circuits of FIGS. 7 and 8 the common base connection point of bipolar transistors Q1 and Q2 is used as a voltage reference node, with the reference voltage being communicated to outside circuitry via other circuitry (not shown).

Thus, it has been shown that the application of the principles of the present invention improves bandgap voltage, or bandgap current, accuracy with respect to possible variations in supply voltage. It has been shown to be of particular benefit where the bipolar devices used in the circuit have a low $V_a$, although even at $V_a$ values of 100 volts, some improvement occurs. The new circuit maintains the advantages of prior art bandgap circuits, while maintaining better performance than the original circuit down to supply voltages as low as 2.5 volts and below, although precision above 3 volts is considerably improved in current process technologies. In current state of the art process technologies, circuits employing the principles of the present invention may be employed with great advantage for analog operation down to 3.3 volts.

Although the present invention and its advantages have been described in detail, and various embodiments have been disclosed, it should be understood that various additional changes, substitutions and alterations can be made herein without departing from the spirit and scope of the invention as defined by the appended claims. For example, the polarity of the voltages and semiconductor devices may be the reverse of that described herein, the compensating current mirror may be cascoded, etc. All such variations are considered encompassed by the present invention.

What is claimed is:

1. A reference circuit, comprising:

a current generation circuit having a first bipolar transistor and a second bipolar transistor connected as a current mirror and being coupled by way of their emitters and collectors between a voltage source and ground; and a MOS device circuit functioning to minimize the voltage difference between the collector of said first bipolar transistor and said second bipolar transistor.

2. A reference circuit according to claim 1 wherein said reference circuit is a bandgap reference circuit, and wherein said MOS device circuit comprises a current mirror.

3. A bandgap reference circuit according to claim 2 wherein said first bipolar transistor has its emitter connected to ground; and said second bipolar transistor has its emitter coupled to ground through a first resistor.

4. A bandgap reference circuit, comprising:

a current generation circuit having a first bipolar transistor, and a second bipolar transistor, said first bipolar transistor and said second bipolar transistor being connected as a current mirror and having their bases coupled together by way of a common node, and being coupled by way of their emitters and collectors between a voltage source and ground, a beta helper device coupled to said common node, to said voltage source and to the collector of said first bipolar transistor;

a MOS device circuit functioning to minimize the voltage difference between the collector of said first bipolar transistor and said second bipolar transistor.

5. A bandgap reference circuit according to claim 4 wherein said MOS device circuit comprises a current mirror.

6. A bandgap reference circuit according to claim 5 wherein:

said first bipolar transistor has its emitter connected to ground; and said second bipolar transistor has its emitter coupled to ground through a first resistor.

7. A bandgap reference circuit comprising:

a current generation circuit comprising a bipolar current mirror comprising a first bipolar transistor and a second bipolar transistor connected together at a common connection node, and being coupled by way of their emitters and collectors between a voltage source and ground, and a first MOS circuit coupled to the collectors of said bipolar transistor current mirror and providing current thereto;

a voltage generation circuit comprising a resistive leg comprising first resistor and a bipolar transistor having its collector and base connected together, said first resistor and said bipolar transistor being connected in series between an output node and ground, a second MOS circuit coupled to said current generation circuit and mirroring a current generated in said current generation circuit to said resistive leg, and a beta helper MOS circuit including a first MOS device coupled by way of its source and drain between said common connection node and said voltage source, having its gate coupled to said first MOS circuit, and providing a supplemental current to said resistive leg; and a third MOS circuit functioning to minimize the voltage difference between the collector of said first bipolar transistor and said second bipolar transistor, coupled to said gate of said first MOS device and to the collectors of said first bipolar transistor and said second bipolar transistor.

8. A bandgap reference circuit according to claim 7 wherein:

in said bipolar current mirror said first bipolar transistor has its emitter connected to ground, said second bipolar transistor has its emitter coupled to ground through a second resistor, and the bases of said first bipolar transistor and of said second bipolar transistor are connected to said common connection node;

said first MOS circuit comprises a cascoded current mirror circuit having a first side and a second side, said first side providing current to the collector of said first bipolar transistor, and said second side providing current to the collector of said second bipolar transistor;

said first MOS device in said beta helper MOS circuit has its gate connected to said first side of said cascoded current mirror circuit; and said third MOS circuit comprises a second MOS device having its source connected to the collector of said first bipolar transistor, having its gate and drain connected to said first side of said cascoded current mirror circuit, and a third MOS device having its source connected to the collector of said second bipolar transistor, having its drain connected to said second side of said cascoded current mirror circuit, and having its gate connected to said gate of said second MOS device.

9. A bandgap reference circuit comprising:

a first current generation circuit comprising a bipolar current mirror comprising a first bipolar transistor and a second bipolar transistor connected together at a common connection node, and being coupled by way of their emitters and collectors between a voltage source and ground, and a first MOS circuit coupled to the collectors of said bipolar transistor current mirror and providing current thereto;

a second current generation circuit comprising a first MOS device coupled between an output node and ground, a second MOS circuit coupled to said current generation circuit and mirroring a current generated in said current generation circuit to said first MOS device, and a beta helper MOS circuit including a second MOS device coupled by way of its source and drain between said common connection node and said voltage source, having its gate coupled to said second MOS circuit, and providing a supplemental current to said first MOS device; and a third MOS circuit functioning to minimize the voltage difference between the collector of said first bipolar transistor and said second bipolar transistor, coupled to said gate of said second MOS device and to the collectors of said first bipolar transistor and said second bipolar transistor.

10. A bandgap reference circuit according to claim 9 wherein:

in said bipolar current mirror said first bipolar transistor has its emitter connected to ground, said second bipolar transistor has its emitter coupled to ground through a resistor, and the bases of said first bipolar transistor and of said second bipolar transistor are connected to said common connection node;

said first MOS circuit comprises a cascoded current mirror circuit having a first side and a second side, said first side providing current to the collector of said first bipolar transistor, and said second side providing current to the collector of said second bipolar transistor;

said second MOS device in said beta helper MOS circuit has its gate connected to said first side of said cascoded current mirror circuit; and said third MOS circuit comprises a third MOS device having its source connected to the collector of said first bipolar transistor, having its gate and drain connected to said first side of said cascoded current mirror circuit, and a fourth MOS device having its source connected to the collector of said second bipolar transistor, having its drain connected to said second side of said cascoded current mirror circuit, and having its gate connected to said gate of said second MOS device.

* * * * *